US007815334B2

(12) United States Patent
Sherman

(10) Patent No.: US 7,815,334 B2
(45) Date of Patent: Oct. 19, 2010

(54) WRISTBAND MOUNTABLE FLASHLIGHT ACCESSORY

(76) Inventor: Alan E. Sherman, 7639 Westmoreland Ave., Clayton, MO (US) 63105

( * ) Notice: Subject to any disclaimer, the term of this patent is extended or adjusted under 35 U.S.C. 154(b) by 395 days.

(21) Appl. No.: 11/926,841

(22) Filed: Oct. 29, 2007

(65) Prior Publication Data

US 2009/0108039 A1 Apr. 30, 2009

(51) Int. Cl.
*A45F 5/00* (2006.01)
*F21L 4/00* (2006.01)

(52) U.S. Cl. ..... 362/157; 224/219

(58) Field of Classification Search ..... 362/157; 224/219, 165, 241; 206/538, 540
See application file for complete search history.

(56) References Cited

U.S. PATENT DOCUMENTS

| | | | | | |
|---|---|---|---|---|---|
| 1,594,215 | A | * | 7/1926 | Sides | 224/219 |
| 1,609,481 | A | * | 12/1926 | McCarthy et al. | 224/219 |
| 1,923,962 | A | | 8/1933 | Worley | |
| 2,805,326 | A | | 9/1957 | Schwartz | |
| 2,953,137 | A | * | 9/1960 | Reece | 224/219 |
| 3,009,614 | A | * | 11/1961 | Simril | 224/219 |
| 3,010,627 | A | * | 11/1961 | Hoover | 224/219 |
| 3,112,889 | A | | 12/1963 | Marmo et al. | |
| 3,321,617 | A | | 5/1967 | Santana | |
| 3,402,808 | A | * | 9/1968 | Yannuzzi | 224/219 |
| 3,680,751 | A | * | 8/1972 | Ten Brook | 224/219 |
| 3,924,304 | A | * | 12/1975 | Grandmont | 224/165 |
| 3,944,803 | A | | 3/1976 | Chao | |
| 4,425,600 | A | | 1/1984 | Barnhart | |
| 4,628,418 | A | | 12/1986 | Chabria | |
| 4,788,631 | A | | 11/1988 | Fuller | |
| 4,910,652 | A | | 3/1990 | Rhine | |
| 4,935,851 | A | | 6/1990 | Wood | |
| 5,154,506 | A | | 10/1992 | Leard | |
| 5,193,896 | A | | 3/1993 | Oberlander | |
| D344,411 | S | | 2/1994 | Henry et al. | |
| D353,012 | S | | 11/1994 | Mihavetz | |
| 5,548,565 | A | | 8/1996 | Aoyama et al. | |
| 5,568,971 | A | | 10/1996 | Jewell | |
| D405,202 | S | | 2/1999 | Fattori et al. | |
| 5,904,280 | A | | 5/1999 | Chan | |
| 6,213,619 | B1 | | 4/2001 | Yu | |
| 6,550,930 | B1 | | 4/2003 | Portouche | |
| 6,715,897 | B2 | | 4/2004 | Rowe et al. | |
| 7,023,763 | B2 | | 4/2006 | Galli | |
| 2005/0018544 | A1 | | 1/2005 | Galli | |
| 2005/0018546 | A1 | | 1/2005 | Galli | |
| 2005/0254229 | A1 | | 11/2005 | Hamade et al. | |

* cited by examiner

*Primary Examiner*—David V Bruce
(74) *Attorney, Agent, or Firm*—Polster, Lieder, Woodruff & Lucchesi, L.C.

(57) ABSTRACT

A wristband mountable accessory is provided which includes a body, a flashlight in said body, and an upper compartment sized and shaped to hold medications (such as tablets, pills, lozenges, etc.) and paper upon which medical and/or emergency information can be written. Mounting wings extend from opposite sides of the body to enable the accessory to be mounted to a wristband by threading the wristband through the mounting wings. The mounting wings are provided with sizing pegs so that the accessory can accommodate a variety of sizes (widths) of wristbands.

22 Claims, 7 Drawing Sheets

WRISTBAND MOUNTABLE FLASHLIGHT ACCESSORY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This application relates to wristband mountable flashlights, and, in particular, to a wristband mountable flashlight which includes a compartment in which a user can keep vital medical information and medication.

Often individuals do not have a convenient place to keep medication that may be needed on an irregular basis. Such medications would include, for example, antacid tablets, aspirin, nitroglycerin tablets, etc. Additionally, individuals do not typically carry with them vital medical information which would be important in the case of emergency. Such medical information includes, for example, blood type, drug allergies, contact information, etc. It would be desirable to provide a device which an individual can use to conveniently, yet unobtrusively, store such medications and medical information.

BRIEF SUMMARY OF THE INVENTION

An illustrative wristband mountable flashlight accessory includes a body having a front, a back, sides, a top and a bottom. A bulb is positioned at the front surface (so as to direct light forwardly) and is operated by a switch positioned along one of the back, sides or top of the body. The bulb is powered by a battery or batteries, and the switch, battery and bulb are in electrical communication with each other to define an electrical circuit such that the bulb can be turned on and off by operation of the switch.

An upper compartment formed in the body. The upper compartment opens from the back top of the body. The upper compartment is defined in part by an upper compartment back wall which is shorter than the height of the body, thereby defining a back opening into the upper compartment. The upper compartment includes a first upper compartment portion sized to receive medication, tablets, lozenges, or the like and a second upper compartment portion sized to receive a sheet, which can contain medical and/or emergency information. The body can include indicia indicating that the accessory contains medical and/or emergency information therein. In an illustrative embodiment, the upper compartment is generally L-shaped, and the first compartment is a back compartment and the second compartment is a side compartment.

A cover is hingedly mounted to the body to close the upper compartment. The cover includes a rigid or rigidized back portion which closes the back opening to the upper compartment and a rigid or rigidized top portion which closes the upper compartment from the top. The cover back and top portions are joined so that they may move angularly relative to each other. In the illustrative embodiment, the cover top and back portions are joined by a bendable or flexible corner, which is defined by a radiused or curved flexible portion of the cover. The cover back portion is hingedly connected to the body at the body back.

Lastly, the accessory includes mounting wings extending from opposite sides of the body to enable the accessory to be mounted to a wristband, such as a watch band. In a preferred embodiment, the mounting wings are formed such that the band is threaded through the mounting wings. The mounting wings each comprise front and back arms extending from the body sides and a web extending between the arms. The web comprises a front edge, a back edge, an outer edge and an inner edge; the web inner edge being spaced from the body side. The mounting wing, in combination with the body side wall, defines an opening through which a wristband can pass. At least the wing arms are flexible in a vertical plane to enable the wings to curve about a wearer's arm.

To facilitate mounting the accessory to different types of wristbands, the web is adapted to be split to enable a wristband to be slid through the web. The web comprises a groove or a slot which extends from either the web front edge or the web back edge to communicate with the web inner edge. If a groove is provided, the groove is sized such that the web is frangible along the groove, to split the web along the groove. If a slot is provided, the web can include frangible threads which extend across the slot.

Further, the mounting wings each include at least one positioning pin extending inwardly from the web inner edge towards the accessory body. The pin being sized and shaped to be removed from the wing to help maintain the orientation of the accessory relative to the watchband for watchbands of different widths.

In an illustrative embodiment the bulb, switch and battery are contained in a flashlight module, and the body includes a flashlight compartment sized and shaped to receive the flashlight module. The flashlight compartment is defined at least in part by the front of the body, and the body front includes an opening which is aligned with the bulb. In an illustrative embodiment, the flashlight compartment is a bottom compartment. The body also includes an opening through which the switch is accessible. The switch can also be positioned at the front of the flashlight module, and in this instance, the bulb opening and the switch opening can be formed together. The accessory can be provided with a cover plate sized to cover the battery compartment. The cover plate is removably mounted to the body, to facilitate access to the flashlight module.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
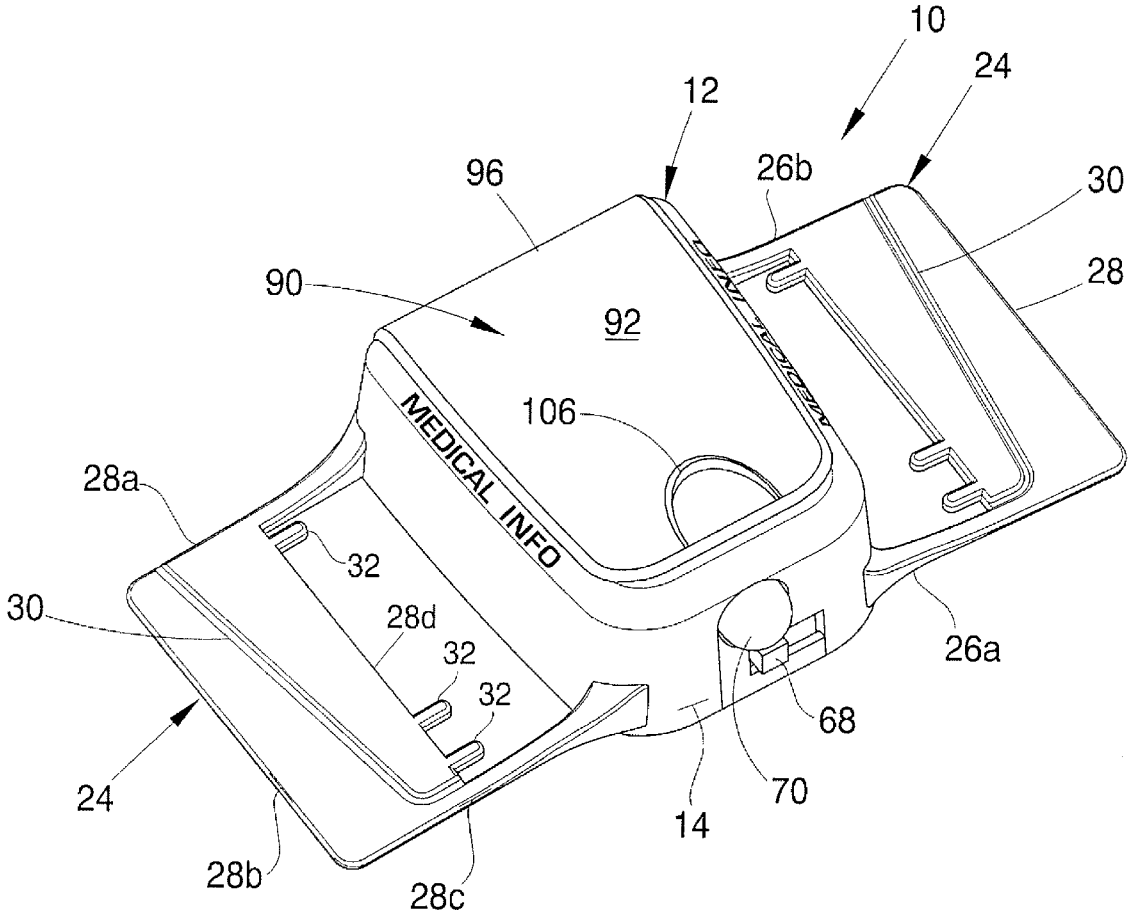
FIG. 1 is a top front perspective view of an illustrative embodiment of a wristband mountable flashlight accessory of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 2:
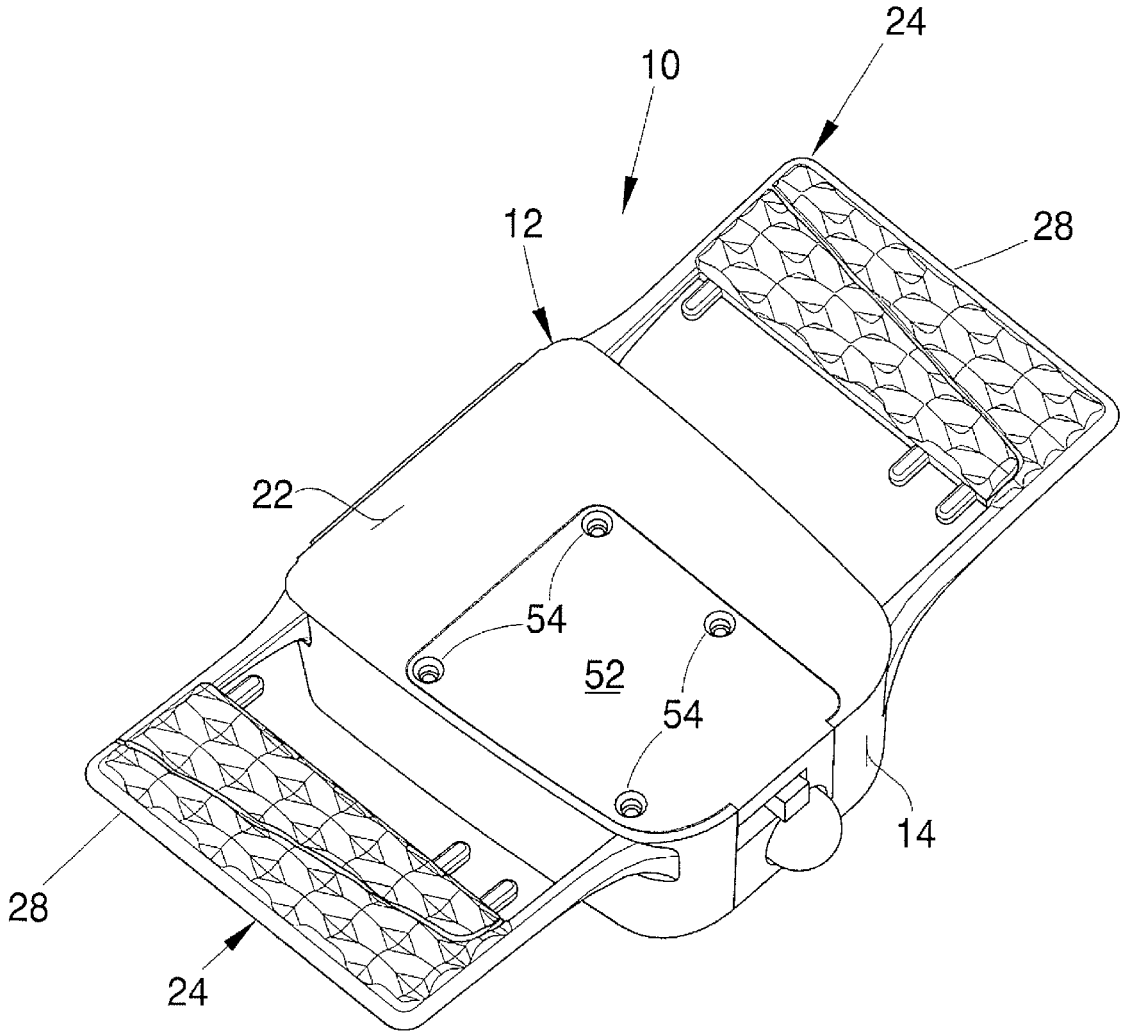
FIG. 2 is a bottom front perspective view of the wristband mountable flashlight accessory.

An illustrative embodiment of wristband mountable flashlight accessory 10 is shown generally in the Figures. The wristband mountable flashlight accessory includes a body 12 having a front 14, a back 16, sides 18, a top 20 and a bottom 22. A mounting wing 24 extends from the bottom of each side 18 to enable the wristband mountable flashlight accessory 10 to be mounted to a wristband, such as a watch band. The mounting wings 24 are flexible in a vertical plane such that the wings 24 can bend to conform generally to the curvature of a wearer's arm. The mounting wings 24 each include a front arm 26*a*, a back arm 26*b*, and a web 28 extending between the arms 26*a,b*. The front and back arms are both vertically flexible, and can take on a curvature in the vertical plane. As seen in FIG. 2, the bottoms of the webs 28 are textured. When the wristband mountable flashlight accessory is worn, the textured bottoms of the webs will gently engage the wearer's skin to help maintain the position of the accessory on the wristband.

A groove or recess 30 extends generally diagonally across the web 28. As seen, the groove 30 extends from a back edge 28*a* of the web near an outer edge 28*b* of the web diagonally inwardly toward a front edge 28*c* of the web. At about the point where the groove 30 is level or flush with the front wing arm 26*a*, the groove 30 curves inwardly, and ends at the inner edge 28*d* of the web 28 just inside of the wing front arm 26*a*.

The wing arms 26*a,b* and web member 28 define an area or opening sized to receive a wristband, such as a watch band. If the band to which the accessory is to be mounted is an open band (i.e., has two band parts which are connected to a watch at one end, and which are buckled together at another end), then one of the band parts can be threaded over the web 28 of a first wing, through the area defined by that first wing, under the accessory body, up into the area defined by the second wing, and then over the web of the second wing. If the watch band to which the accessory is to be mounted is continuous or fully wrist-encircling band (i.e., a metal expandable band), the band can be opened at the spring pin (i.e., where the band is connected to the watch), or, the webs 28 can be sliced through at the groove, and the wristband can be slid through the sliced groove 30 into position. The web members are flexible. Thus, the two parts of the webs 28 formed when the groove is slit can be flexed to open a space between the two parts of each web through which the watch band can be slid into the area defined by the wings.

Not all watch bands are the same width. Even a slight difference in the width of the band can effect how the band is received in the mounting wings (i.e., how much movement or play the band has in the mounting wings). To allow the accessory to be mounted to bands of different widths, the mounting wings 24 include a plurality of pins or posts 32 (three are shown) which extend from the inner edge 28*d* of the web 28 towards the body side wall 18. These pins or posts can be removed (such as with a scissors or cuticle clipper) to alter the effective size of the wing opening. If a watch band is of a size that it requires all three posts removed, then all three posts can be removed. If the watch band is sized such that it will fit between the front and rear pins, then only the middle pin need be removed. As can be appreciated, the three pins 32 allow for at least four different effective and usable widths. The number of effective and usable widths can be varied by altering the position of the three pins or by using more or fewer pins. The pins (if used) give the wing opening an effective width that will be only slightly greater than the width of the wristband, and thereby substantially prevent the accessory from pivoting relative to the wristband. Stated differently, the wing opening will have an effective width that will maintain the orientation of the accessory relative to the wristband.

Figure 4:
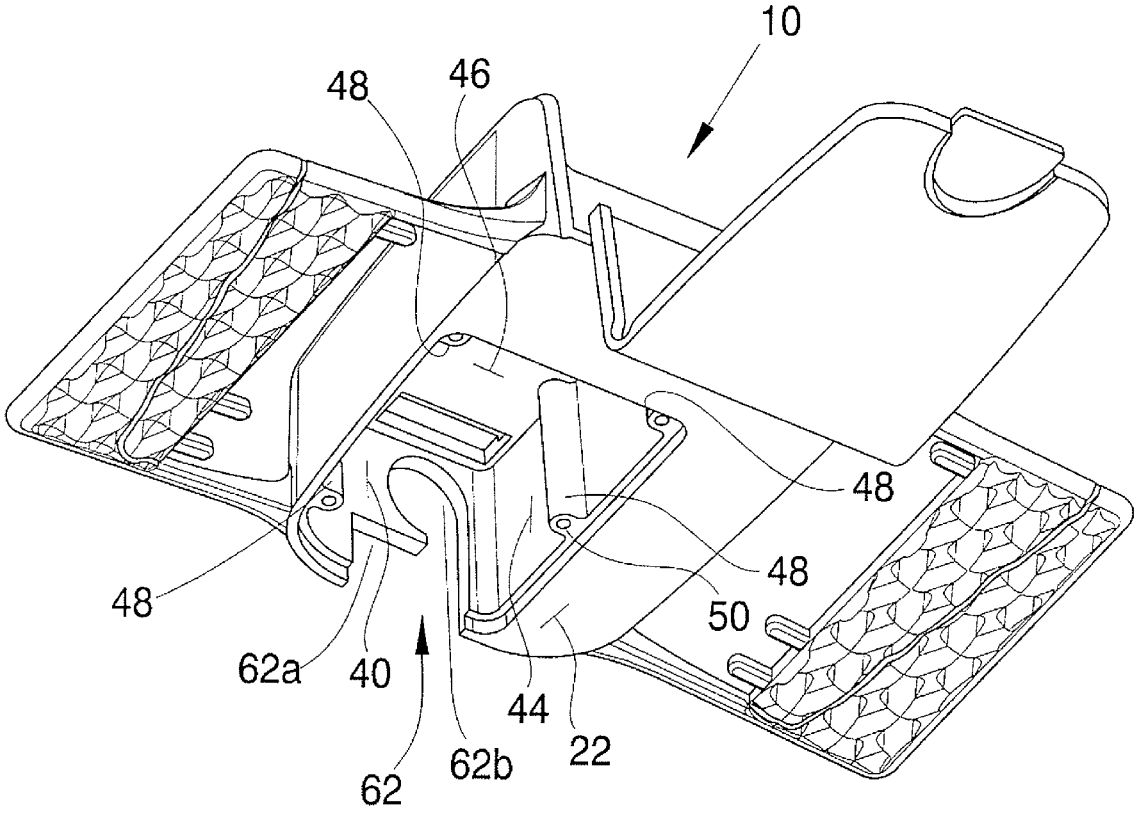
FIG. 4 is a bottom perspective view of the wristband mountable flashlight accessory in an opened position.
Figure 5:
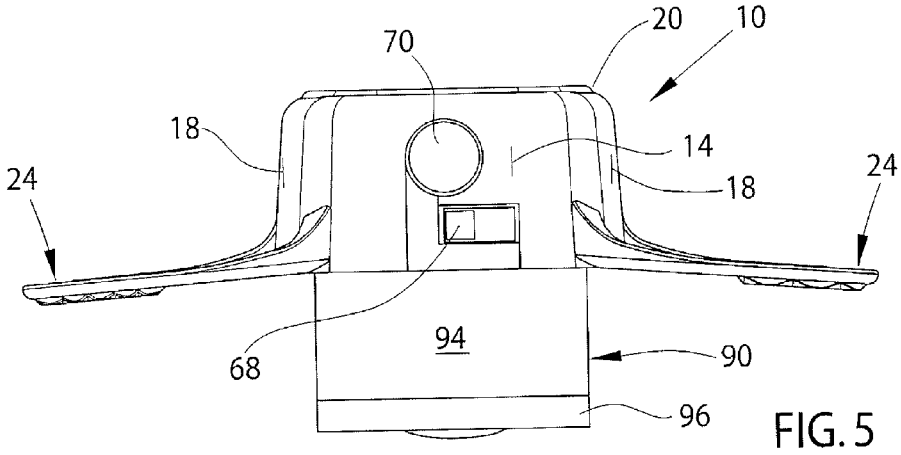
FIG. 5 is a front elevational view of the wristband mountable flashlight accessory in the opened position.
Figure 6:
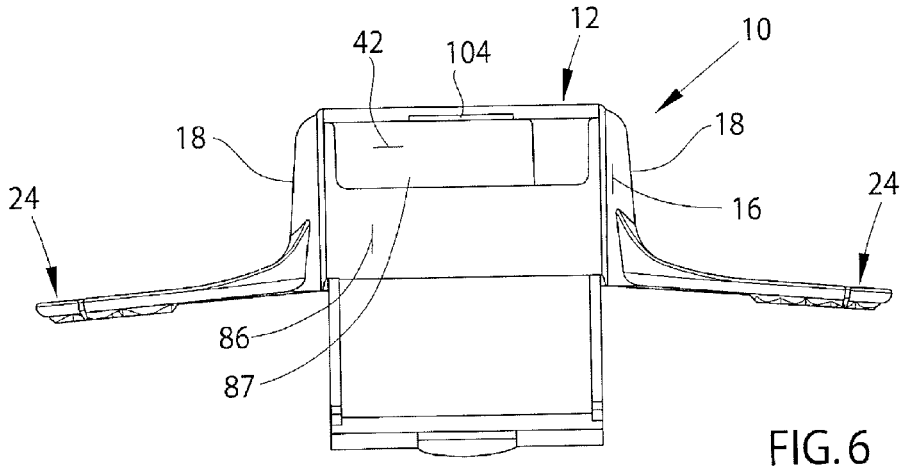
FIG. 6 is a rear elevational view of the wristband mountable flashlight accessory in the opened position.
Figure 7:
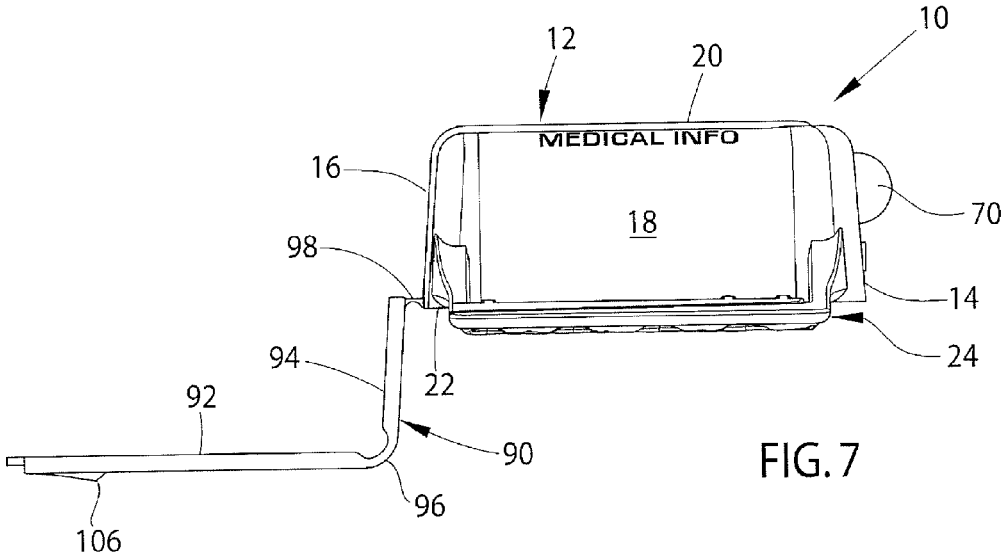
FIG. 7 is a side elevational view of the wristband mountable flashlight accessory in the opened position.

The body 12 includes a flashlight compartment 40 (FIG. 4) which is formed in the bottom 22 of the body 12. As seen in FIG. 4, the compartment 40 extends along a portion of the front 14 and a portion of a side 18 of the body 12. The flashlight compartment is smaller than the body 12. The compartment is thus defined by a back wall 42 (FIG. 11), a side wall 44 (FIG. 9), a top surface 46, a portion of the body front wall 14, and a portion of the body side wall 18. The top surface 46 is spaced slightly below the top of the body, as seen, for example in FIG. 2. Four posts 48 are formed in the recess 40. Two posts 48 are at the back corners of the recess 40, and the other two posts are positioned along the sides of the recess 40. The posts 48 each have a screw hole 50 formed therein. As seen in FIG. 2, a cover plate 52 is provided to close the recess 40. The cover plate 52 has four holes 54 positioned to be aligned with the posts 48 and their screw holes 50. As can be appreciated, screws (not shown) can be driven through the cover plate holes 54 into the post screw holes 50 to secure the cover plate 52 in place. As best seen in FIG. 4, a small lip is formed around the bottom of the walls defining the recess 40. This cover plate 52 rests on this lip, and the lip is sized so that the cover plate 52 will be substantially flush with the body bottom surface 22, as seen in FIG. 2

Figure 9:
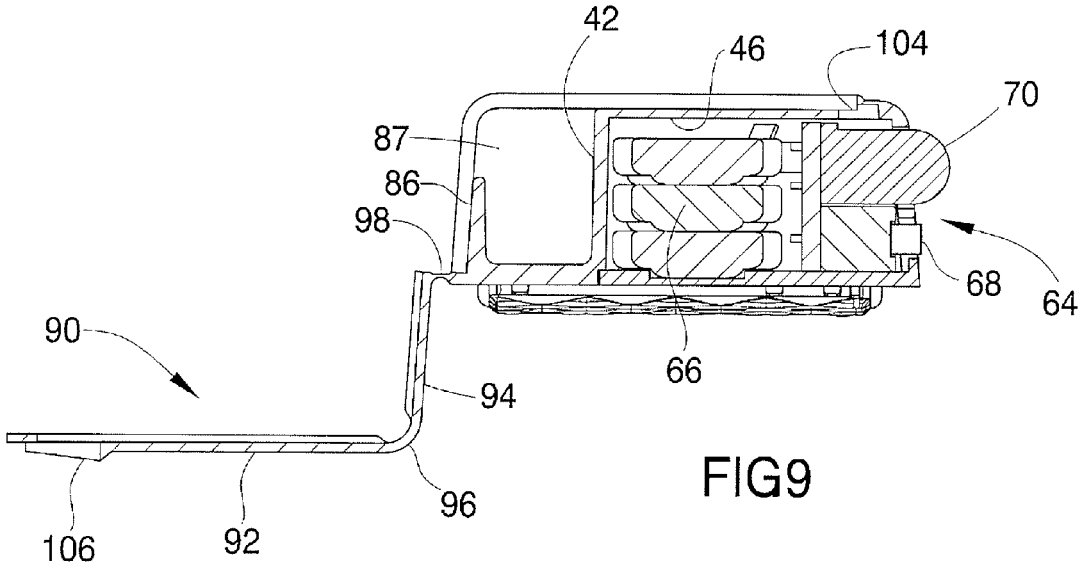
FIG. 9 is a cross-sectional view taken along line A-A of FIG. 8.
Figure 10:
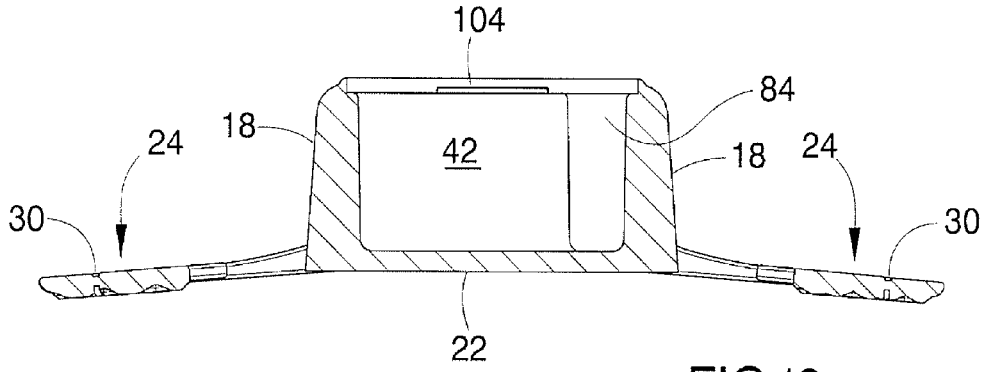
FIG. 10 is a cross-sectional view taken along line B-B of FIG. 8.
Figure 11:
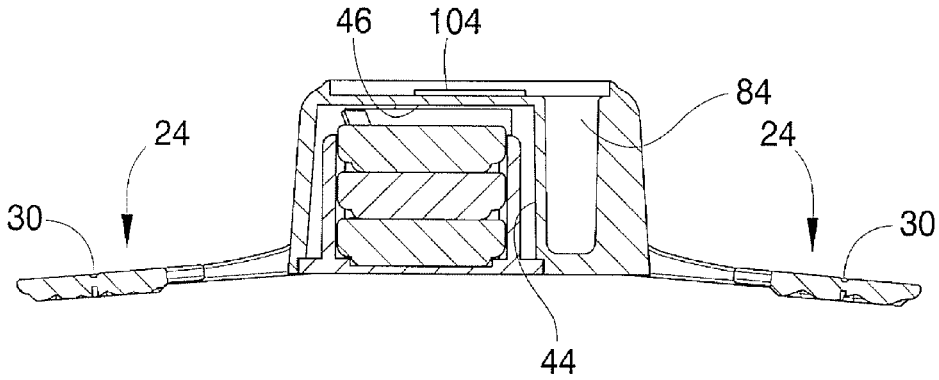
FIG. 11 is a cross-sectional view taken along line C-C of FIG. 8.

An opening 62 is formed in the body front 14 which extends upwardly from the body bottom 22 and opens into the compartment 40. The opening 62 can be described to include a lower rectangular portion 62*a* and an upper generally circular portion 62*b* with an opening between the portions 62*a* and 62*b*. The opening 62 is positioned along the front body surface 14 such that the slot upper portion is generally centered relative to the body front 14. The upper portion 62*b* could also be shaped an arched portion rather than a generally circular portion The flashlight compartment 40 is sized and shaped to receive a flashlight module 64. The flashlight module 64 houses batteries 66 and circuitry (not shown) including a switch 68 to operate a bulb 70. As can be appreciated, the batteries, the bulb and the switch are connected together to define a circuit such that the bulb 70 can be activated and deactivated by operation of the switch 68. Preferably, the flashlight module 64 allows for the batteries to be replaced. So that the size of the wrist mountable flashlight accessory can be maintained relatively small, the flashlight module is one in which button-type batteries are used, and wherein the batteries are stacked on top of each other as seen in FIGS. 9 and 11. The bulb 70 can be any type of bulb, such as an LED. The switch 68 can be a slide switch (i.e., is moved between an on and off position) or a toggle switch which will stay in an "on" position without the user needing to maintain the switch in the "on" position. The switch 68 is shown to be positioned below the bulb 70, and the opening 62 is sized and positioned to receive the bulb and the switch. Thus, the switch 68 is accessible through the front 18 of the accessory body allowing for easy operation of the flashlight module 64. The switch 68 could be positioned elsewhere on the flashlight module. For example, the switch could be positioned above or next to the bulb, rather than below the bulb. Alternatively, the switch could be positioned on a different wall of the module (i.e., the switch could be on a side wall, rather than front wall, of the module). As can be appreciated, should the relative positions of the switch and bulb change, the configuration of the opening 62 would have to change as well. In fact, depending on the positions of the bulb and switch, the accessory body 12 may require two distinct openings—one for the bulb and one for the switch.

As can be appreciated, the flashlight module 64 is sized and shaped to be received in the flashlight compartment 40, and is held therein by the cover plate 50. Should the batteries need changing, the cover plate 50 would be removed to gain access to the flashlight module, and then the batteries could be removed from the flashlight module and replaced. If desired, the body 12 could be designed so that the flashlight module could be snap fitted into the compartment 40, such that the cover plate 50 would not be needed.

Figure 3:
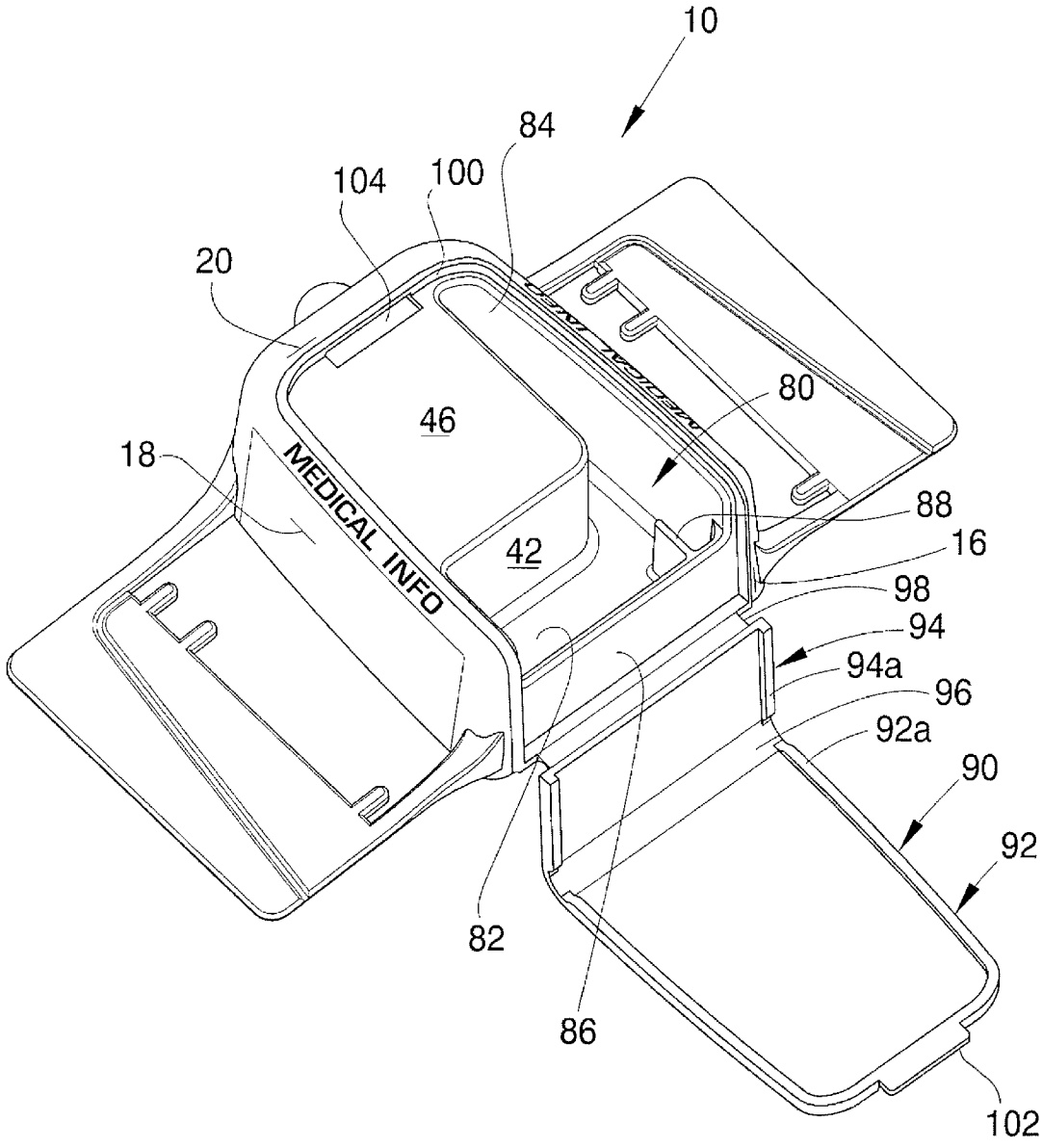
FIG. 3 is a top rear perspective view of the wristband mountable flashlight accessory in an opened position.

Because the flashlight compartment 40 is smaller than the body 12, the body includes a corresponding upper compartment 80 which opens from the top of the body 12. The upper compartment 80 is generally L-shaped and includes a back portion 82 and a side portion 84. The upper compartment 80 is defined by a body side wall 18, the flashlight compartment walls 42 and 44, and a back wall 86. As seen in FIG. 3, the back wall 86 is set inwardly slightly from the back 16 of the body and is shorter than the body 12; that is, the top of the upper compartment back wall 86 is below the top 20 of the accessory body 12. The back portion 82 and the side portion 84 of the upper compartment 80 are separated at the back of the body by a partition 88 which extends forwardly from the upper compartment back wall 86. The partition 88 has a height equal to the height of the back wall 86. The partition 88 is shorter than the front-to-back width of the back portion 82 of the upper compartment 80. The partition 88, in effect, divides the upper compartment back portion 82 from the upper compartment side portion 84.

The upper compartment back portion 82 is sized to receive medication that may be needed on a non-regular basis. Such medication would include pain relievers, antacid tablets, lozenges, as well as certain prescription medications, such as nitroglycerin tablets, enzyme tablets, etc. To this end, the upper compartment has a depth (top-to-bottom), and thus the body 12 has a depth of about ¾"-⅞". The depth of the body 12 (and of the upper compartment 80) can be altered, as desired, to accommodate larger pills or tablets, or smaller to accommodate only smaller pills or tablets. The shorter back wall 86 forms an opening 87 into the compartment back portion 82. This back opening 87 into the compartment back portion facilitates removal of medication from the compartment back portion 82 when necessary. The compartment side portion 84 is sized to receive a sheet medium (which can be in folded form) which can be written upon to contain information that may be important in the case of emergencies. Such information includes, for example, blood type, identification information, contact information, medicine allergies, medicine currently being taken, etc. The sheet medium can be paper, but would preferably be a water resistant material which can be written upon, such that the information will not be lost if the sheet medium gets wet.

The compartment 80 is closed by an L-shaped cover 90 having a top portion 92 and a back portion 94 which are joined or connected together so that the cover top and back portions can move or bend relative to each other. In the illustrative embodiment shown, the cover top and back portions are joined by a bendable or flexible curved or radiused portion 96. The cover top and back portions can be joined together by other means which would still allow for the two portions to move relative to each other. For example, they could be joined or connected by a living hinge. The cover top has a rib **92*a* which extends around the side and front edges of the top; and the cover back has a rib 94*a* which extends along the sides of the cover back. As best seen in FIG. 9, the ribs 92*a* and 94*a* give added width to the cover top and back portions, making these portions somewhat more rigid than the curved portion 96. The ribs 92*a* and 94*a* rigidize the cover top and back portions to prevent the cover top and back portions from flexing along their longitudinal axes. The cover top and back portions can be rigidized by other means. Alternatively, the cover top and back portions can be simply be made thicker so that they will be inherently more rigid than the flexible connection portion 96. As noted above, the cover flexible connecting portion 96** is somewhat flexible, allowing the angle defined by the cover top and back portions to change slightly when finger pressure is applied to the top portion, as will be described below.

The cover 90 is connected to the body 12 by a living hinge 98 which joins the bottom of the cover back portion 94 to the bottom edge of the upper compartment back wall 86. As seen in the Figures, a lip or shoulder 100 is formed around the edge of the compartment 80. The cover ribs **92*a*,94*a* have a thickness substantially equal to the depth of the shoulder 100 such that when the cover is in the closed position, the cover outer surface will be substantially flush with the top 20 and back 16**.

Figure 8:
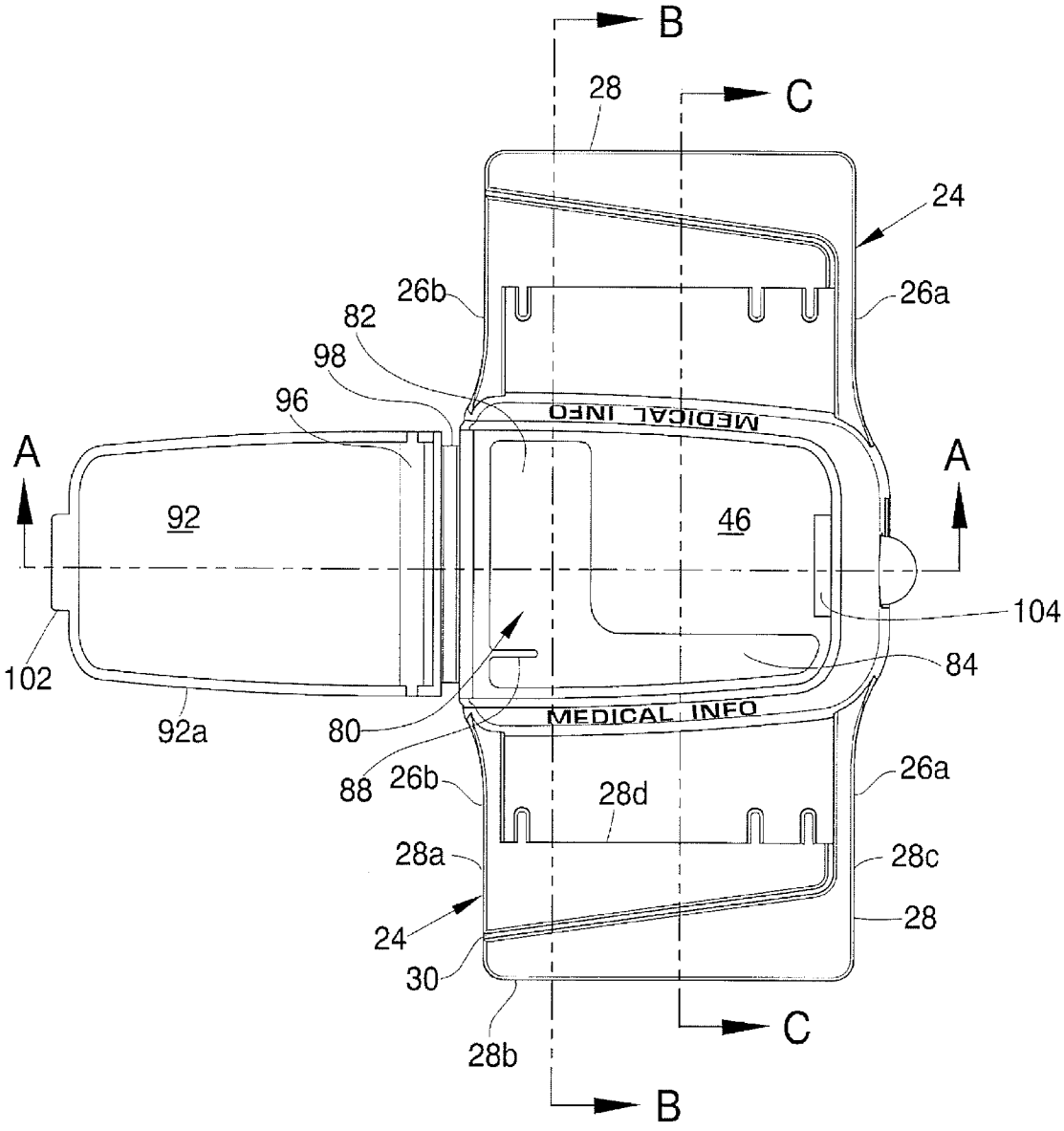
FIG. 8 is a top plan view of the wristband mountable flashlight accessory in the opened position.

To maintain the cover 90 in its closed position, the cover includes a tab 102 at a forward end of the cover top portion 92. The accessory body 12 includes a slot 104 (FIGS. 3 and 8) formed in the top wall 46 of the flashlight compartment and which extends under the body top surface 20. The tab 102 and the slot 104 are sized such that the tab 102 can be received in the slot. As can be appreciated, when the tab is received in the slot, the cover will not be able to flex about the flexible connecting portion 96; nor will the cover be able to pivot about its hinge 98. The cover 90 therefore will be maintained in its closed position. To facilitate opening of the compartment 80 (even in dim light) so as to gain access to the medication (or papers) held therein, the cover 90 includes a recess (which dips below the upper surface of the cover top portion. The recess is surrounded by a curved rib or raised edge 106. The curved rib and recess define a tactilely identifiable finger grip which allows for a user to slide the cover top portion 92 rearwardly until the cover tab 102 is withdrawn from the body slot 104. As can be appreciated, as the cover top portion 92 is moved rearwardly along (or parallel to) the plane of the top of the accessory body 12, the cover 90 will flex or bend slightly about its flexible connecting portion 96, thereby altering the angle between the cover top portion 92 and cover back portion 94. Additionally, the cover back portion 94 may pivot slightly about the hinge 98. Unlike the top portion 92 and back portion 94, the cover connecting portion 96 does not include ribs, making the curved portion flexible thereby facilitating the rearward sliding motion of the cover top portion 92 relative to the body 12, as just described.

From the forgoing, it can be determined that the wristband mountable flashlight accessory 10 has several beneficial features. Some of the features include:

The web 28 (which can be split if necessary) and pins 32 of the mounting wings 24 allow the accessory 10 to be installed on a wide variety of different sized and types of watchbands, from traditional buckle end bands to fixed loop metal bands.

The pins 32 allow for the effective width of the opening defined by the mounting wings to be altered to allow for different sized wristbands to pass through the opening. The pins are positioned to provide for effective widths which will substantially prevent the accessory from rotating or pivoting relative to the wristband. This will help ensure that the flashlight is always facing forwardly.

The flashlight switch 68 allows the flashlight to remain illuminated without the need for the user to physically maintain the switch in a closed position. This allows the user to use both hands when performing a task. Further, the light from the flashlight module 24 will shine directly toward the user's finger tips to help illuminate the task underway.

As long as the wristband mountable flashlight accessory is worn, it will be always readily available in emergency situations, to provide the wearer access to medication contained therein or to provide the wearer or emergency personnel access to the information sheet contained therein. Thus, the user will not have to search through a purse or pockets to find medication; nor will emergency personnel need to explore for information necessary in an emergency situation. Preferably, the outside of the body 12 has indicia (either in symbols or in words) which will inform emergency personnel that medical information is contained within the accessory 10. If in the form of symbols, the indicia can be a red cross, the phrase "medical information inside", or other similar indicia.

The upper compartment 80 is easily accessible, allowing ready access to medications and/or information that may be contained therein.

The design of the body 12 physically separates the upper compartment 80 (which contains medication) from the flashlight compartment 40 (which houses the flashlight module) to prevent any type of contamination that might otherwise occur.

The flashlight module 64 is compact, and this compact size is facilitated by the use of a stack of button-type batteries. The use of a stack of batteries, rather than a line of batteries, allows for the use of a single spring clip as part of the flashlight's circuitry. The net result is that the accessory can have a fairly low profile on a watch band. In fact, the height of the accessory can be approximately ½", which is about the same height of many watch models. As noted above, the height of the accessory can be smaller or larger to accommodate different sized pills, tablets, lozenges, etc or to accommodate different sized emergency/medical information sheets.

The upper and flashlight compartments 40 and 80 have radiused interior plane intersections. This enhances the structural integrity of the entire body 12 and also makes it easier to clean the compartments. The compartments can be cleaned by simple wiping with a damp tissue. This would not be possible if the interior intersections came to a sharp (rather than radiused) corner.

Finally, the outer surface of the accessory (and especially the outer surface of the cover top portion 92) can be printed or molded with logos or other indicia, and thus can serve as a source of advertising. Such indicia can also include the above noted indicia to inform medical or emergency personnel that the accessory contains medical alert information.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense. For example, although the wristband accessory 10 is shown to incorporate a flashlight module, the flashlight could be built into the accessory body 12. In this instance, the body would include a battery compartment. The web groove 30 could be replaced with a slit, in which case, the mounting wing webs 28 would be two-part webs. Alternatively, the groove 30 can be formed such that the webs 28 are easily frangible along the groove, such that the webs can be easily split. The curved portion 96 of the cover 90 could be replaced with a flexible hinge connection. Although the groove 30 of the mounting wing webs 28 extend from the back edge **28*a* of the web, the groove could extend rearwardly from the front edge 28*c* of the web. In this instance, the groove would essentially be the mirror image of the groove 30 as shown in the figures. Although the flashlight module is housed in a bottom compartment, the body could be formed such the flashlight compartment is a second upper compartment. That is, it could be opened through the top of the flashlight body. In this instance, the cover plate 52 could be accessible by opening the cover 90. In a further variation, the accessory can be formed without the flashlight. The finger grip can comprise solely the raised edge or rib 106 or solely the recess. If the latter, the recess can be provided be textured to increase friction at the recess during opening of the cover 90**. These examples are merely illustrative.

The invention claimed is:

1. A wristband mountable accessory comprising:

a body having a front, a back, sides, a top and a bottom;

an upper compartment formed in said body, said upper compartment opening from said back of said body and from said top of said body; said upper compartment being defined in part by an upper compartment back wall shorter than the height of said body; said upper compartment including a first upper compartment portion sized to receive medication and a second upper compartment portion sized to receive paper;

a cover having a back portion and a top portion joined by a connecting portion which permits said cover back and top portions to move angularly relative to each other; said cover back portion closing the opening to said upper compartment from the back of said body and the cover top portion closing said upper compartment from the top of said body; said cover back portion being handedly connected to said body at said body back; and mounting wings extending from opposite sides of said body, said mounting wings being shaped to permit a wristband to be threaded through said wings.

2. The wristband mountable accessory of claim 1 wherein said cover top and back portions being joined by a flexible curved portion.

3. The wristband mountable accessory of claim 1 wherein said cover top portion and said cover back portion are generally rigid.

4. The wristband mountable accessory of claim 1 wherein said cover top portion includes a tab extending from a front edge of thereof; and said body includes a rearwardly facing slot at the front of said body; said cover tab and said body slot being aligned such that said tab is received in said slot when said cover is closed.

5. The wristband mountable accessory of claim 4 wherein said cover includes a finger grip on an upper surface of said cover top portion; said finger grip facilitating opening of said cover.

6. The wristband mountable accessory of claim 1 wherein said mounting wings each comprise front and back arms extending from said body sides and a web extending between said arms; said web comprising a front edge, a back edge, an outer edge and an inner edge; said web inner edge being spaced from said body side; said mounting wing, in combination with said body side wall, defining an opening through which a wristband can pass.

7. The wristband mountable accessory of claim 6 wherein at least said wing arms are flexible in a vertical plane to enable the wings to curve about a wearer's arm.

8. The wristband mountable flashlight accessory of claim 6 wherein said mounting wings each include at least one positioning pin extending inwardly from the web inner edge towards said accessory body; said pin being sized and shaped to be removed from said wing to facilitate mounting of said accessory on watchbands of different widths.

9. The wristband mountable accessory of claim 6 wherein said web is adapted to be split to enable a wristband to be slid through said web.

10. The wristband mountable accessory of claim 9 wherein said web comprises one of a groove or a slot; said groove or slot extending from either said web front edge or said web back edge to communicate with said web inner edge.

11. The wristband mountable accessory of claim 1 wherein said upper compartment is generally L-shaped; said first compartment portion defining a back compartment portion and said second compartment portion defining a side compartment portion.

12. The wristband mountable flashlight accessory of claim 11 wherein said back compartment is sized to receive medication, tablets, lozenges, or the like, and the side compartment is sized and shaped to receive a sheet medium which can be written upon.

13. The wristband mountable accessory of claim 1 wherein said body including indicia indicating that said accessory contains medical and/or emergency information therein.

14. The wristband mountable accessory of claim 1 further comprising a flashlight comprising a bulb positioned at said front surface, a switch positioned along one of said back, sides or top of said body, and a battery; said switch, said battery and said bulb being in electrical communication with each other to define an electrical circuit, whereby, said bulb can be turned on and off by operation of said switch.

15. The wristband mountable accessory of claim 14 wherein said flashlight bulb, switch, and battery are contained in a flashlight module; said body further comprising a flashlight compartment; said flashlight module being received in said flashlight compartment; said flashlight compartment having an opening in a front thereof through which said flashlight bulb can emit light and an opening through which the switch is accessible.

16. The wristband mountable flashlight accessory of claim 15 wherein said opening for said bulb and said opening for said switch are both on said body front.

17. The wristband mountable flashlight accessory of claim 15 including a cover plate sized to cover said flashlight compartment; said cover plate being removably mounted to said body.

18. A wristband mountable accessory comprising:

a body having a front, a back, sides, a top and a bottom;

an upper compartment formed in said body, said upper compartment opening from said back of said body and from said top of said body; said upper compartment being defined in part by an upper compartment back wall shorter than the height of said body; said upper compartment including a first upper compartment portion sized to receive medication, tablets, lozenges and the like, and a second upper compartment portion sized to receive paper;

a cover for said upper compartment; said cover being hingedly connected to said body to be selectively movable between an opened position and a closed position; and mounting wings extending from opposite sides of said body, said mounting wings each comprising front and back arms extending from said body sides and a web extending between said arms; said web comprising a front edge, a back edge, an outer edge and an inner edge; said web inner edge being spaced from said body side; said mounting wing, in combination with said body side wall, defining an opening through which a wristband can pass; at least said mounting wing arms being flexible.

19. The wristband mountable accessory of claim 18 wherein said mounting wings each include at least one positioning pin extending inwardly from the web inner edge towards said accessory body; said pin being sized and shaped to be removed from said wing to alter the effective width of said mounting wing opening.

20. The wristband mountable accessory of claim 18 wherein said web is adapted to be split to enable a wristband to be slid through said web.

21. The wristband mountable accessory of claim 20 wherein said web comprises one of a groove or a slot; said groove or slot extending from either said web front edge or said web back edge to communicate with said web inner edge.

22. A wristband mountable accessory comprising:

a body having a front, a back, sides, a top and a bottom;

an upper compartment formed in said body, said upper compartment opening from said back of said body and from said top of said body; said upper compartment being defined in part by an upper compartment back wall shorter than the height of said body; said upper compartment including a first upper compartment portion sized to receive medication, tablets, lozenges and the like, and a second upper compartment portion sized to receive paper;

a cover having a back portion and a top portion joined by a connecting portion which permits said cover back and top portions to move angularly relative to each other; said cover back portion closing the opening to said upper compartment from the back of said body and the cover top portion closing said upper compartment from the top of said body; said cover back portion being hingedly connected to said body at said body back; and mounting wings extending from opposite sides of said body, said mounting wings being adapted to enable said accessory to be mounted on a wrist band.

* * * * *